US012114762B2

(12) United States Patent
Walton et al.

(10) Patent No.: US 12,114,762 B2
(45) Date of Patent: Oct. 15, 2024

(54) INTEGRATED JACKET AND BACKPACK SYSTEM AND METHOD OF USE

(71) Applicant: Jacpac, LLC, Detroit, MI (US)

(72) Inventors: Wymell D. Walton, Detroit, MI (US); Timothy Gibson, Bloomfield Hills, MI (US)

( * ) Notice: Subject to any disclaimer, the term of this patent is extended or adjusted under 35 U.S.C. 154(b) by 165 days.

(21) Appl. No.: 17/978,775

(22) Filed: Nov. 1, 2022

(65) Prior Publication Data

US 2023/0053239 A1 Feb. 16, 2023

Related U.S. Application Data

(63) Continuation-in-part of application No. 17/083,985, filed on Oct. 29, 2020, now abandoned.

(60) Provisional application No. 62/927,198, filed on Oct. 29, 2019.

(51) Int. Cl.
*A45F 4/12* (2006.01)
*A41D 1/02* (2006.01)

(52) U.S. Cl.
CPC ..... *A45F 4/12* (2013.01); *A41D 1/02* (2013.01); *A41D 2400/48* (2013.01)

(58) Field of Classification Search
CPC ..... A45F 4/12; A45F 2003/003; A45F 4/02; A45F 3/04; A41D 15/04; A41D 2400/42; A45C 13/103
USPC ..... 224/575–576, 153, 650
See application file for complete search history.

(56) References Cited

U.S. PATENT DOCUMENTS

| | | | | |
|---|---|---|---|---|
| 5,344,056 | A | 9/1994 | Challoner et al. | |
| 5,743,448 | A * | 4/1998 | Tsai | A45F 3/04 2/69.5 |
| 5,850,634 | A | 12/1998 | Toombs | |
| 5,860,164 | A | 1/1999 | Johnson | |
| 6,290,114 | B1 | 9/2001 | Berberian | |
| 7,036,641 | B2 | 5/2006 | Russo et al. | |
| 8,870,045 | B1 | 10/2014 | Aguirre | |
| D917,833 | S | 5/2021 | Conway | |
| 2011/0010818 | A1 | 1/2011 | Hood | |
| 2011/0101059 | A1 | 5/2011 | Haralson et al. | |
| 2011/0315285 | A1* | 12/2011 | Verrini | A45C 1/04 150/108 |
| 2013/0327803 | A1 | 12/2013 | Chiang | |
| 2020/0268131 | A1 | 8/2020 | McDowell | |
| 2021/0000246 | A1 | 1/2021 | Alson | |

* cited by examiner

*Primary Examiner* — Adam J Waggenspack
(74) *Attorney, Agent, or Firm* — Law Office of Mark Brown, LLC; Christopher M. DeBacker

(57) ABSTRACT

A transformable backpack and jacket system which allows the backpack to be converted into a jacket and be reversed. The jacket and backpack can also be worn simultaneously, resulting in three total modes of wear. The first mode has a wearable jacked with a backpack, including straps, secured away in pouch in the back of the jacket and covered with a zippered lid. The second mode has the backpack removed from the pouch and worn in conjunction with the jacket. The third mode has the jacket removed and stored within a front panel of the backpack. The jacket and backpack are permanently connected. In all three of the modes, the contents of the backpack remain securely stored within a backpack storage space.

9 Claims, 19 Drawing Sheets

INTEGRATED JACKET AND BACKPACK SYSTEM AND METHOD OF USE

CROSS-REFERENCE TO RELATED APPLICATION

This application is a continuation-in-part of and claims priority in U.S. patent application Ser. No. 17/083,985 filed Oct. 29, 2020, which claims priority in U.S. Provisional Patent Application No. 62/927,198 filed Oct. 29, 2019, which is incorporated herein by reference.

BACKGROUND OF THE INVENTION

1. Field of the Invention

The present invention relates generally to a jacket and backpack system and method for use thereof, and more specifically to an integrated and convertible jacket and backpack system with invisible zipper pouch lid.

2. Description of the Related Art

A backpack is a storage pouch with shoulder straps that is worn on the back of its wearers. Backpacks were originally designed for soldiers and hikers; and today they are widely popular with students and the general public for everyday use.

People use backpacks to store items including school supplies, books, lunch, extra clothing and other essential items. Backpacks allow wearers to carry items without their hands, which is a popular alternative to handbags and briefcases.

To protect from the cold, jackets, coats, and other exterior garments are used by wearers to stay warm. In such instances, when the weather becomes warmer, it is customary for wearers to simply fold up their jackets and store them in backpacks to stay cool while conveniently freeing up their hands.

While the typical backpack has multiple pouches for storage, once the folded jacket has been stored, it reduces the amount of storage space for books, extra clothing, etc. This results in either carrying items outside of the backpack or increasing the weight of the bag which applies more strain on the back of the wearer.

Another problem is having to manage both a jacket and backpack when entering indoor areas, including airports. Going through security checkpoints and forgetting to grab all items, especially closer to flight boarding times, increases the risk of permanent loss of at least one of those two items. This is due to the disconnecting properties and contrasting storage options of each of these two products.

Heretofore there has not been available a system or method for an integrated and convertible jacket and backpack system with the advantages and features of the present invention.

BRIEF SUMMARY OF THE INVENTION

The present invention generally provides a transformable backpack and jacket system which allows the backpack to be converted into a jacket and be reversed. The jacket and backpack can also be worn simultaneously, resulting in three total modes of wear. The first mode has a wearable jacked with a backpack, including straps, secured away in pouch in the back of the jacket and covered with a zippered lid. The second mode has the backpack removed from the pouch and worn in conjunction with the jacket. The third mode has the jacket removed and stored within a front panel of the backpack. The jacket and backpack are permanently connected. In all three of the modes, the contents of the backpack remain securely stored within a backpack storage pouch. The detachable reverse invisible zipper pouch lid has contracting textures, colors and waterproof materials that allows the wearer to detach and reattach the cover "lid" on either the jacket.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Jacket and Backpack System 2

Figure 1:
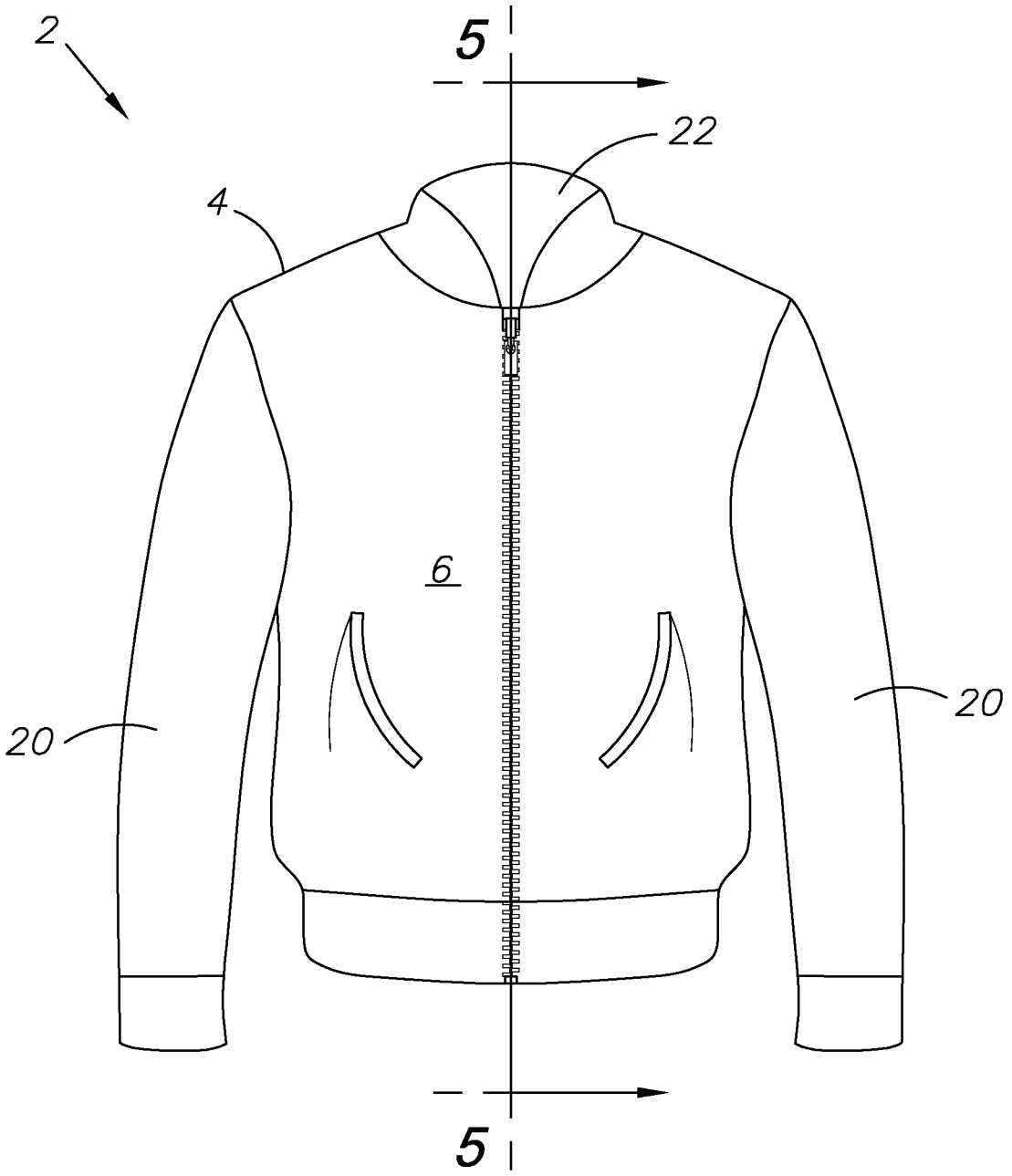
FIG. 1 is a front elevational view of a preferred embodiment of the present invention in a first, jacket-only orientation.
Figure 2:
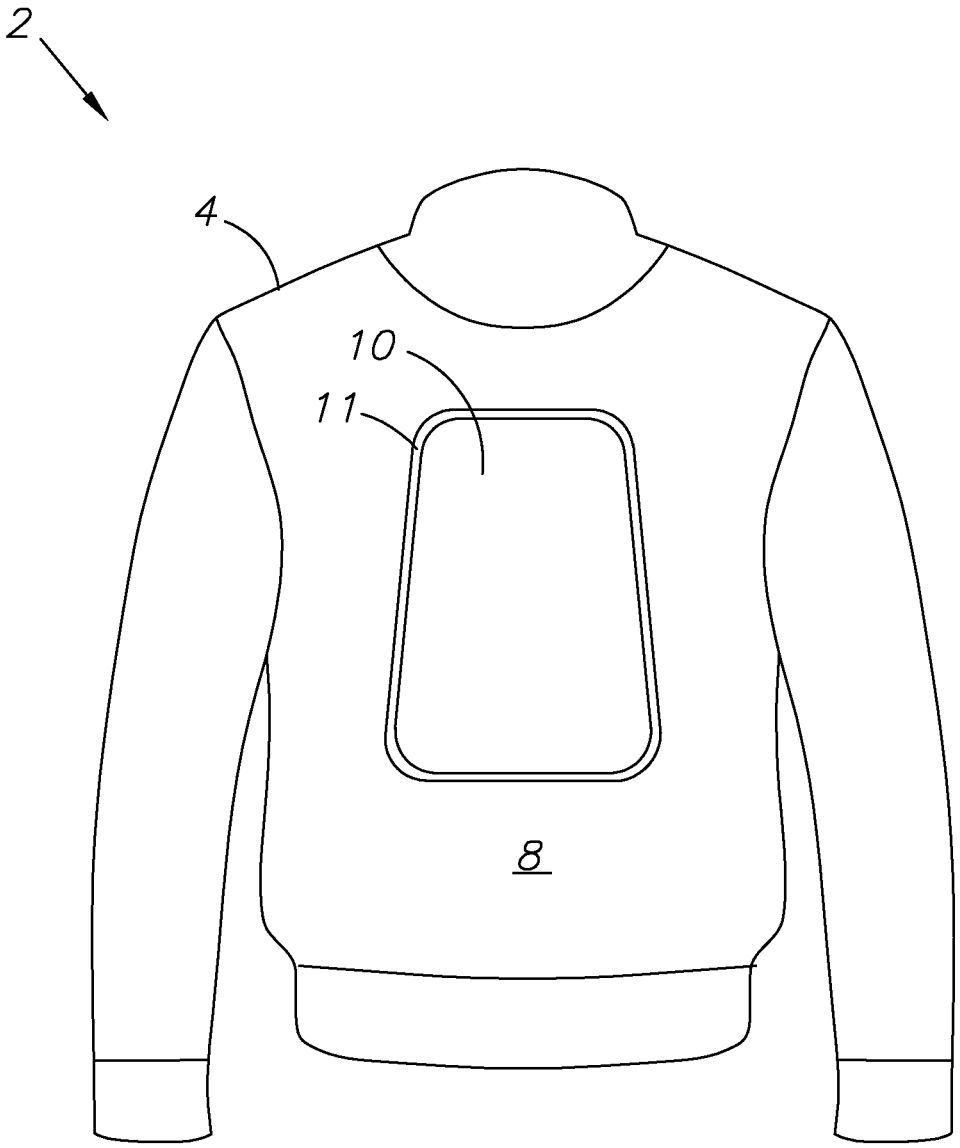
FIG. 2 is a rear elevational view thereof.
Figure 3:
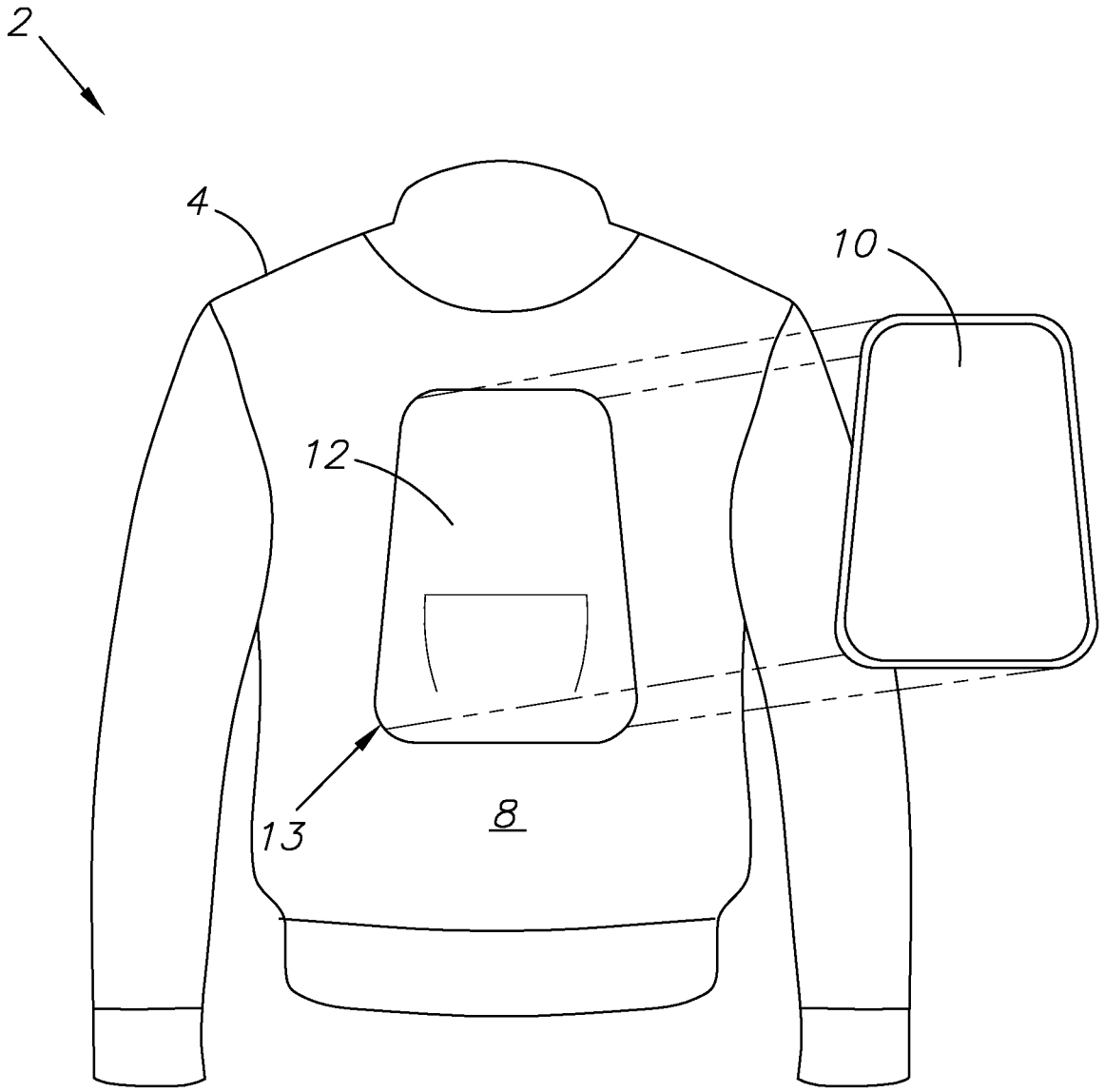
FIG. 3 is a rear elevational view thereof showing the removable panel being removed, exposing a backpack element.
Figure 4:
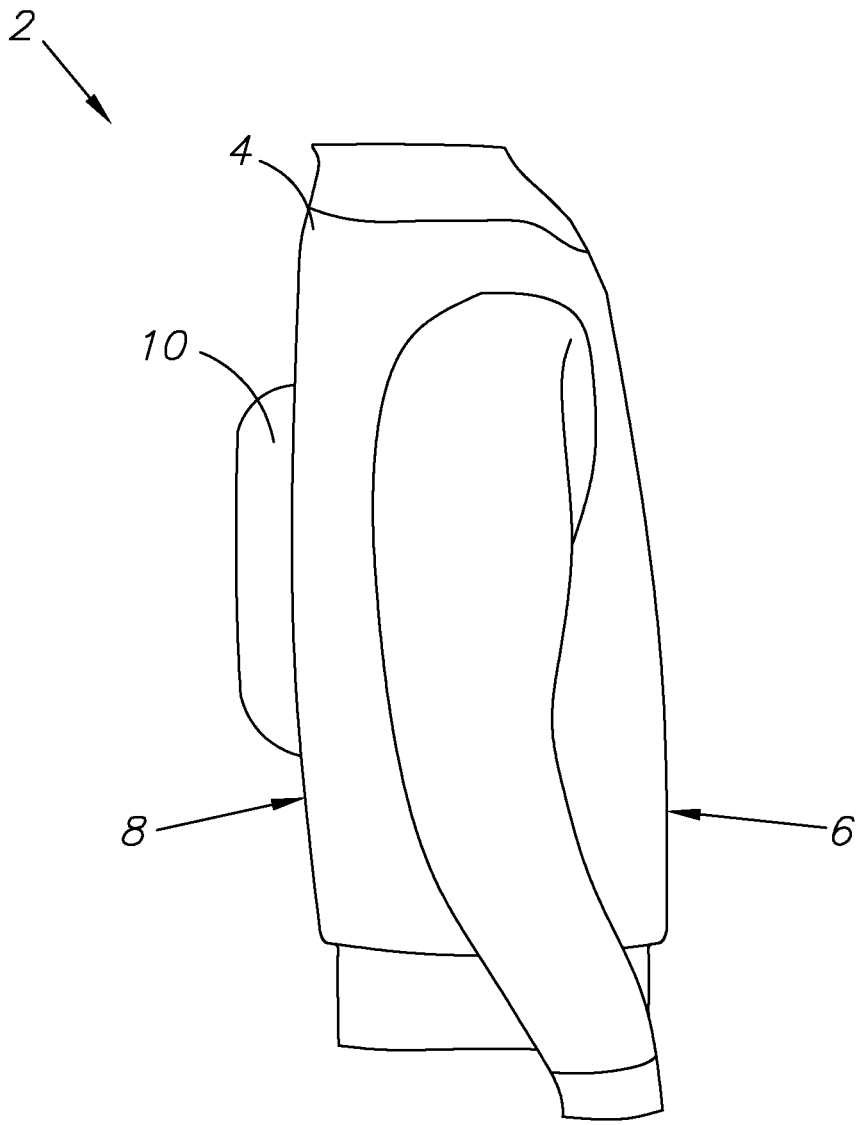
FIG. 4 is a side elevational view of the embodiment as shown in FIGS. 1 and 2.

As shown in FIGS. 1-12, the present invention is a transformable, integrated jacket and backpack system 2. The jacket 4, as shown in FIGS. 1 and 2, can be worn like any typical jacket. The jacket 4 includes sleeves 20, a collar 22, a front face 6 and a rear face 8. A lid 10 connected to the rear face 8 of the jacket 4 via a hidden zipper 11 conceals a backpack 12 as can be seen in FIG. 3. The lid 10 is reversible, having a first face and a second face. Each of those faces can differ, either by including different colors, different materials, or by including usable features such as pockets, straps, clips, or other elements.

Figure 5:
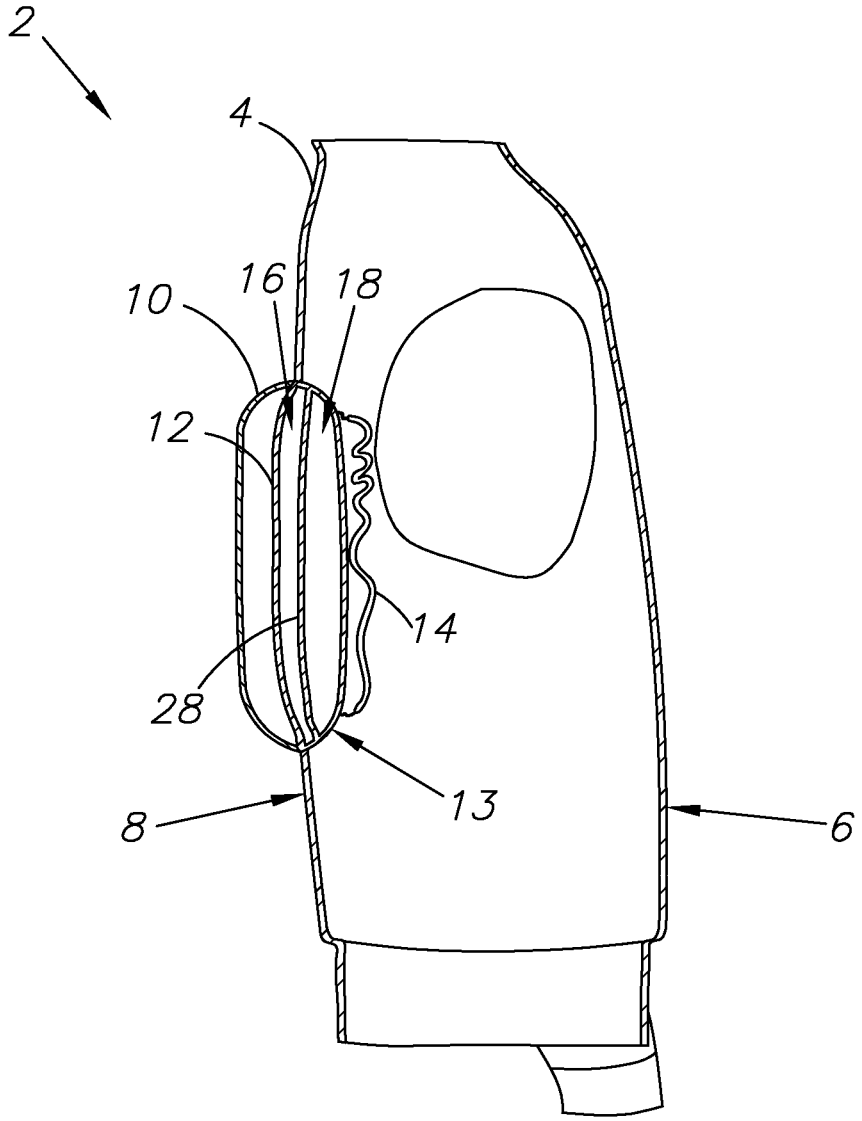
FIG. 5 is a side sectional view taken about the line of FIG. 1.

FIG. 5 shows the interior of the jacket 4 and backpack 12 secured to the jacket via the lid 10. The backpack 12 has a first enclosed storage space 16 and a second enclosed storage space 18 separated by a barrier 28. The first space 16 is for storing items, such as books, laptops, food, or other common items for storing within backpacks. The second space 18 is for storing the jacket 4 when in a third, backpack-only orientation. The two separate spaces 16, 18 allow for items to always be stored and protected within the backpack 12, leaving the jacket 4 to easily be stored or worn as desired. The straps 14 for the backpack 12 are also contained within the pouch 13 of the jacket 4.

Figure 6:
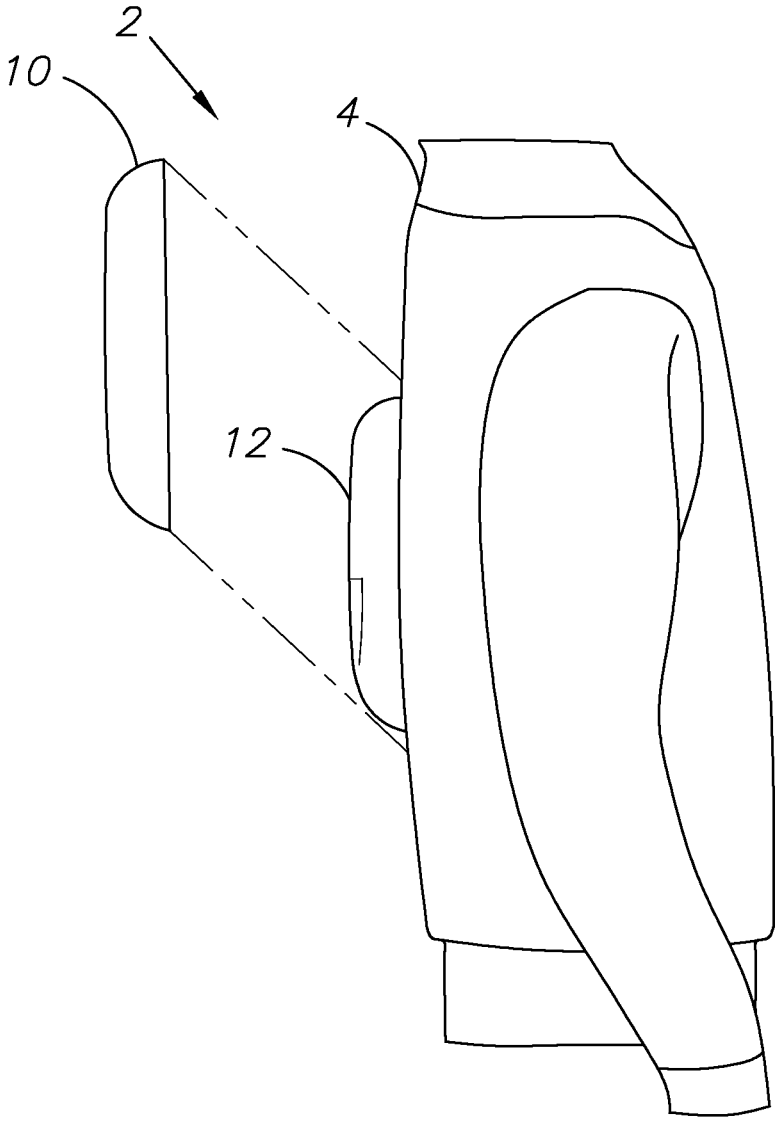
FIG. 6 is a side elevational view of the embodiment as shown in FIG. 3.
Figure 7:
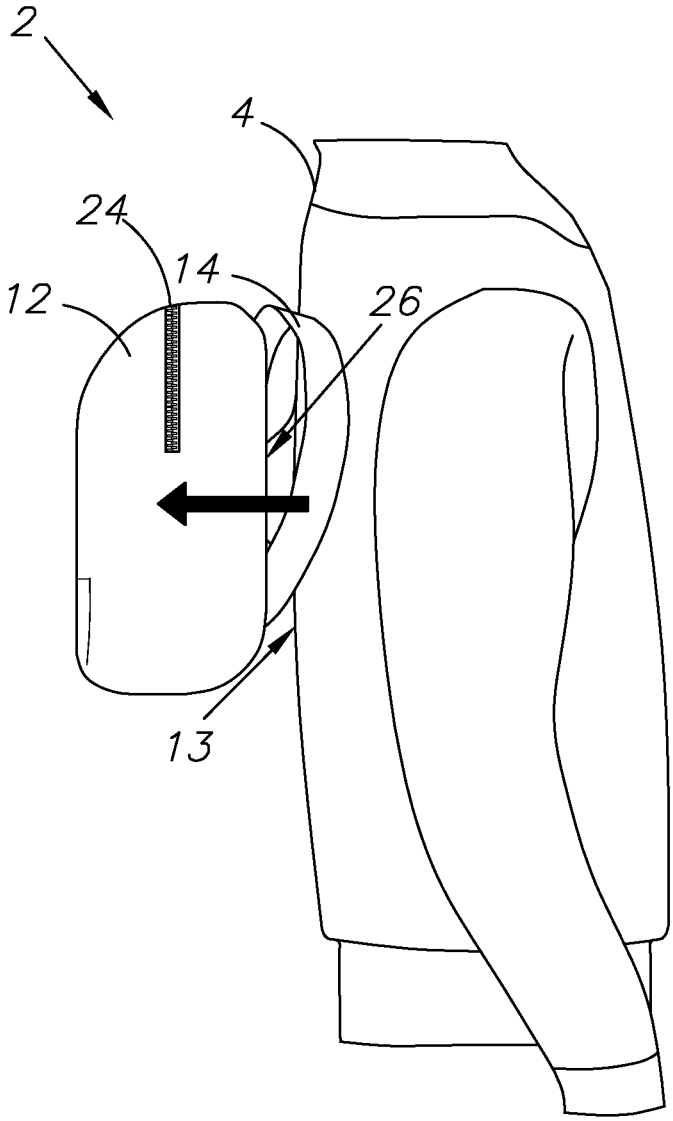
FIG. 7 is a side elevational view showing the backpack element removed from its pouch within the jacket element.
Figure 8:
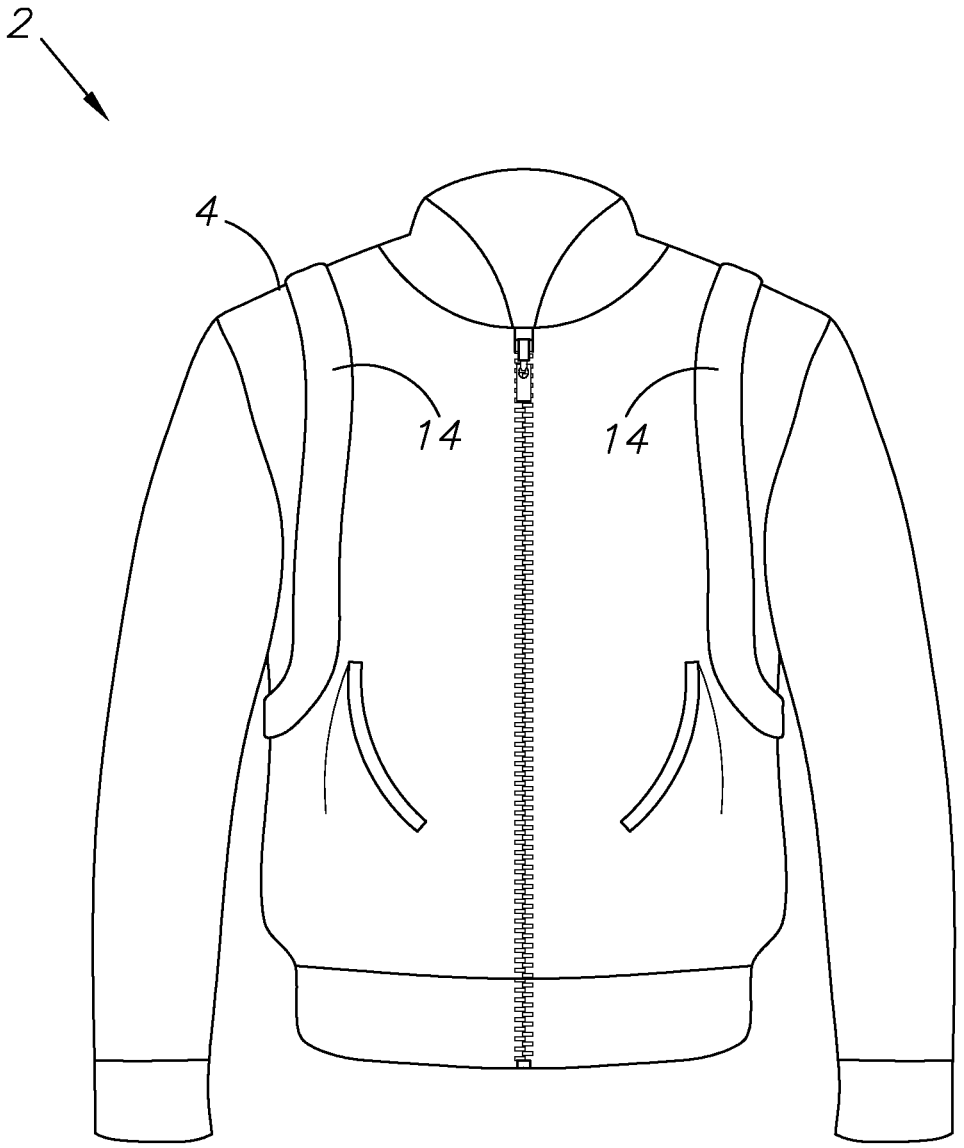
FIG. 8 is a front elevational view of the embodiment of the present invention shown in a second, jacket and backpack orientation.

FIGS. 3 and 6 show how the removable lid 10, which is connected to the jacket 4 via a hidden zipper 11 or other suitable closure, can be taken off to reveal the backpack 12. FIG. 7 shows the backpack 12 being drawn out of the pouch 13 of the jacket 4. The jacket 4 and backpack 12 are permanently connected via a flap 26 connecting to the second space 18 within the backpack. FIG. 7 shows a zippered closure 24 which only accesses the first space 16 within the backpack. FIG. 8 shows when the backpack 12 straps 14 are fit over the sleeves 20 of the jacket 4. This is the second, jacket and backpack orientation.

Figure 9:
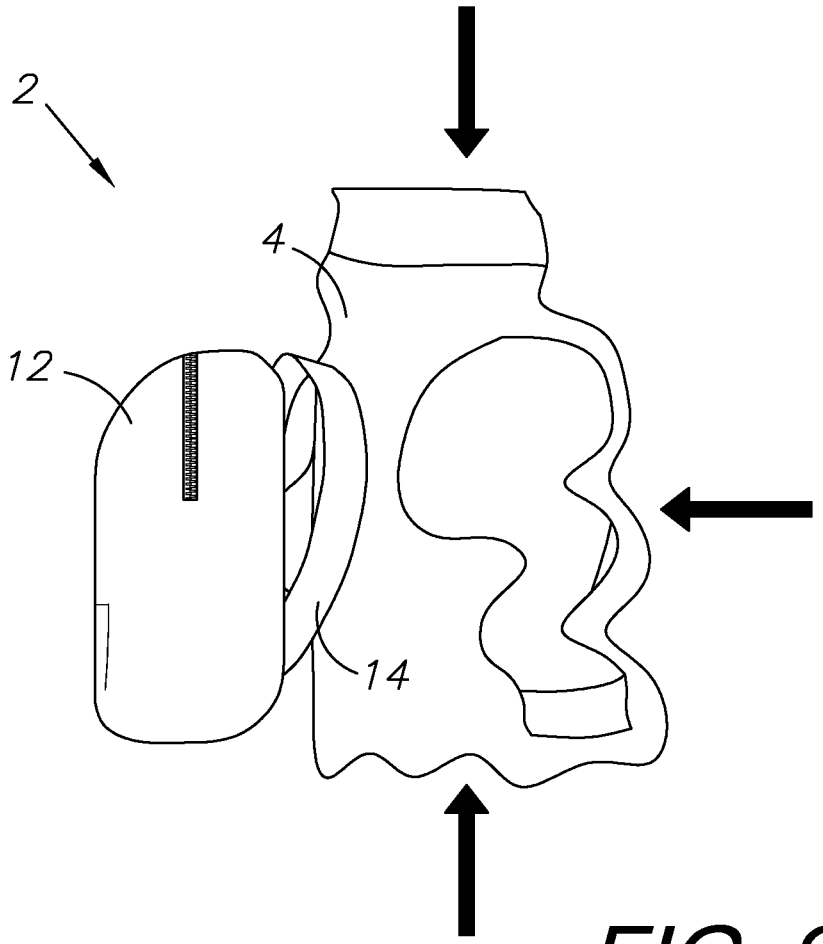
FIG. 9 is a side elevational view showing the embodiment of the present invention being transformed for the second, jacket and backpack orientation to a third, backpack only orientation.
Figure 10:
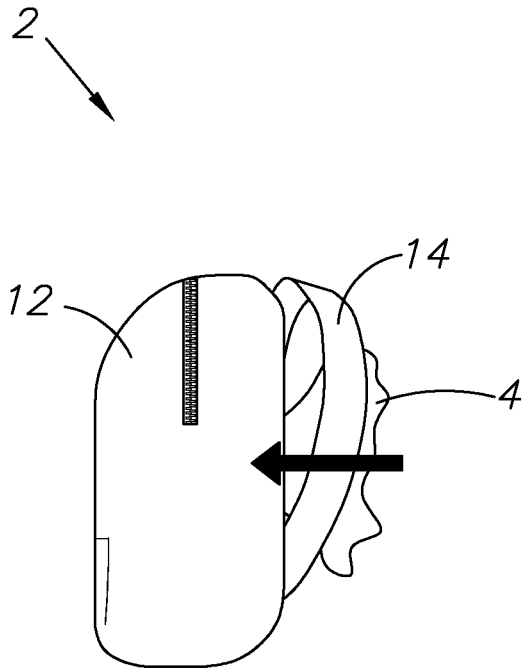
FIG. 10 is another side elevational view showing a second step thereof.
Figure 11:
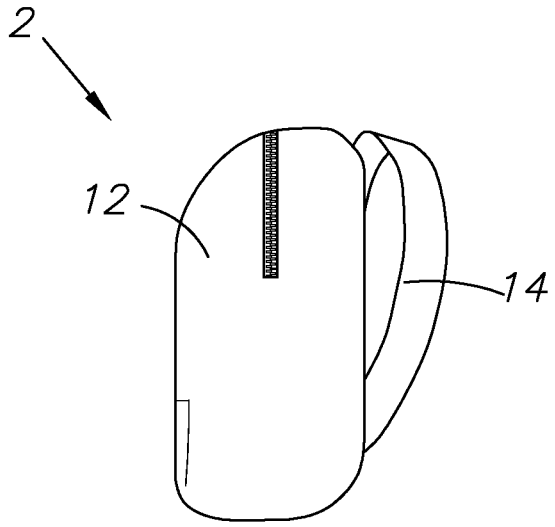
FIG. 11 is a side elevational view of the embodiment of the present invention in the third, backpack only orientation.
Figure 12:
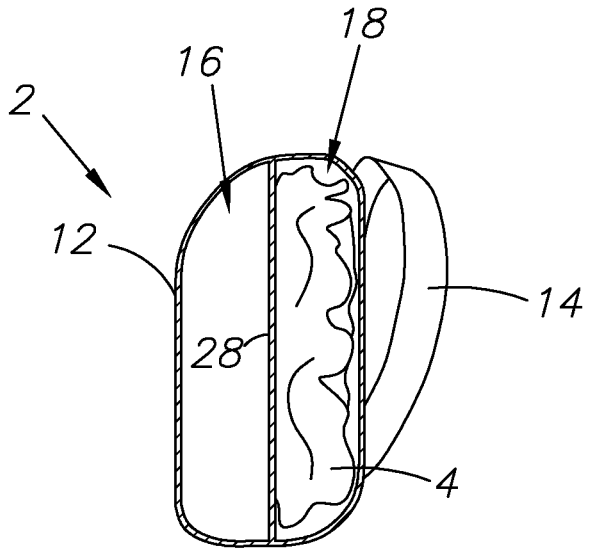
FIG. 12 is a side sectional view thereof.

FIG. 9 shows the jacket 4 and backpack 12 being separated and transformed to the third, backpack only orientation. The jacket 4 is pushed into the backpack 12 second space 18. FIG. 10 shows this continued. FIG. 11 shows the backpack 12 alone. FIG. 12 shows a cross section of the backpack 12 where the jacket 4 is clearly stored within the second space 18, which is permanently separated from the first space 16 via the barrier 28. This can be important if the jacket is wet and also to prevent contents within the first space 16 from spilling out from the backpack when the jacket 4 is being worn in conjunction with the backpack 12.

Figure 13:
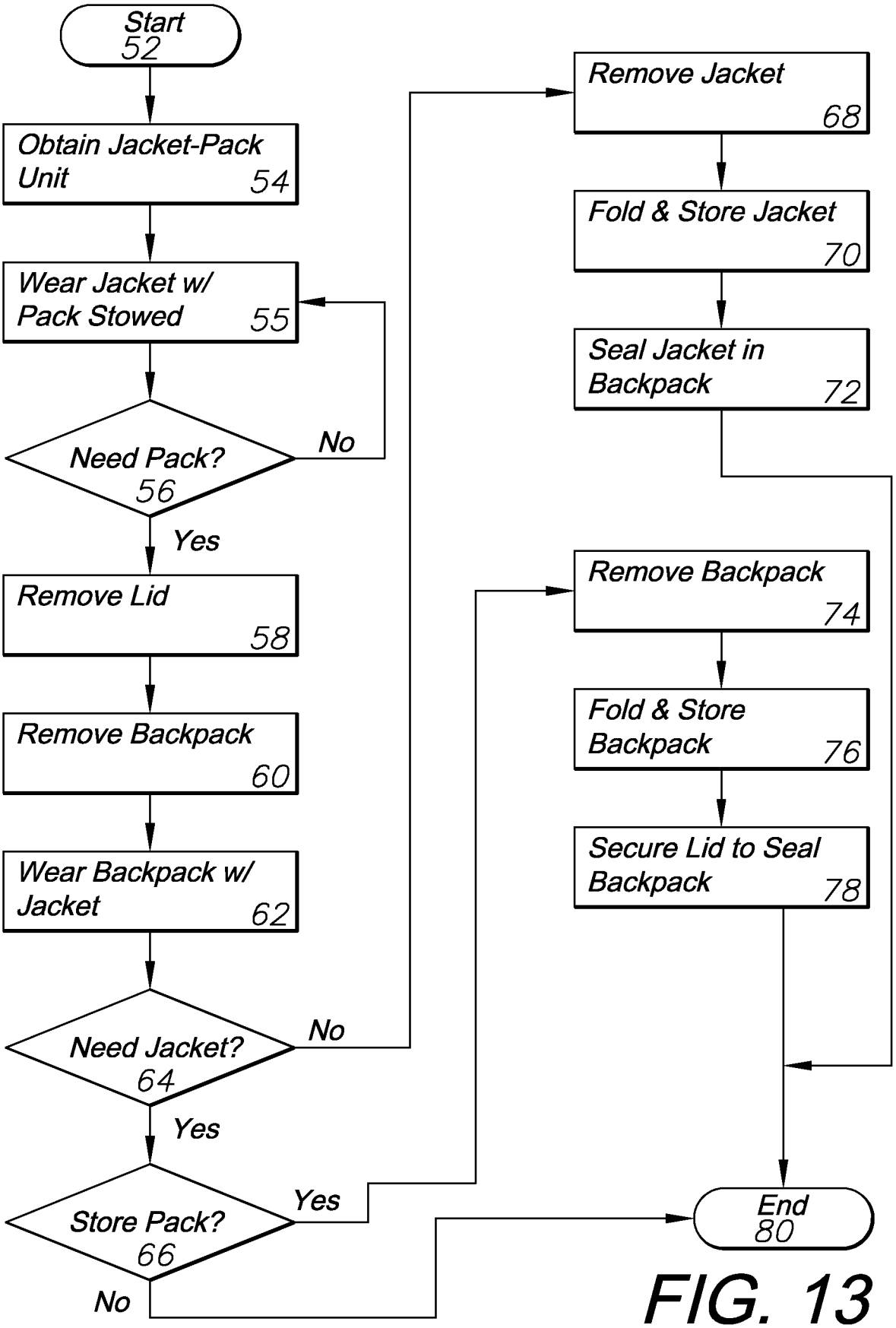
FIG. 13 is a flowchart diagramming the steps taken in practicing an embodiment of the present invention.

FIG. 13 shows the steps taken when practicing a method of using the present invention. The process starts at 52 and the combination jacket and backpack is obtained at 54. The jacket and backpack would be in the first, jacket-only orientation where the backpack is stored within the pouch in the jacket. The jacket can be worn with the backpack stored at 55. If the user needs the backpack at 56, the lid is removed at 58 and the backpack can be taken out of the pouch at 60.

The backpack and jacket are worn in the second orientation at 62. If the user doesn't need the jacket at 64 they can remove the jacket at 68 and store it within the backpack at 70 and seal it in at 72, the process would then end at 80. If the jacket is to remain in use at 64 but the user wants to store the pack at 66, the backpack is removed at 74 and stored within the pouch at 76, which is then sealed with the lid at 78. The process then ends at 80.

III. Alternative Embodiment Jacket and Backpack System 102

Figure 14:
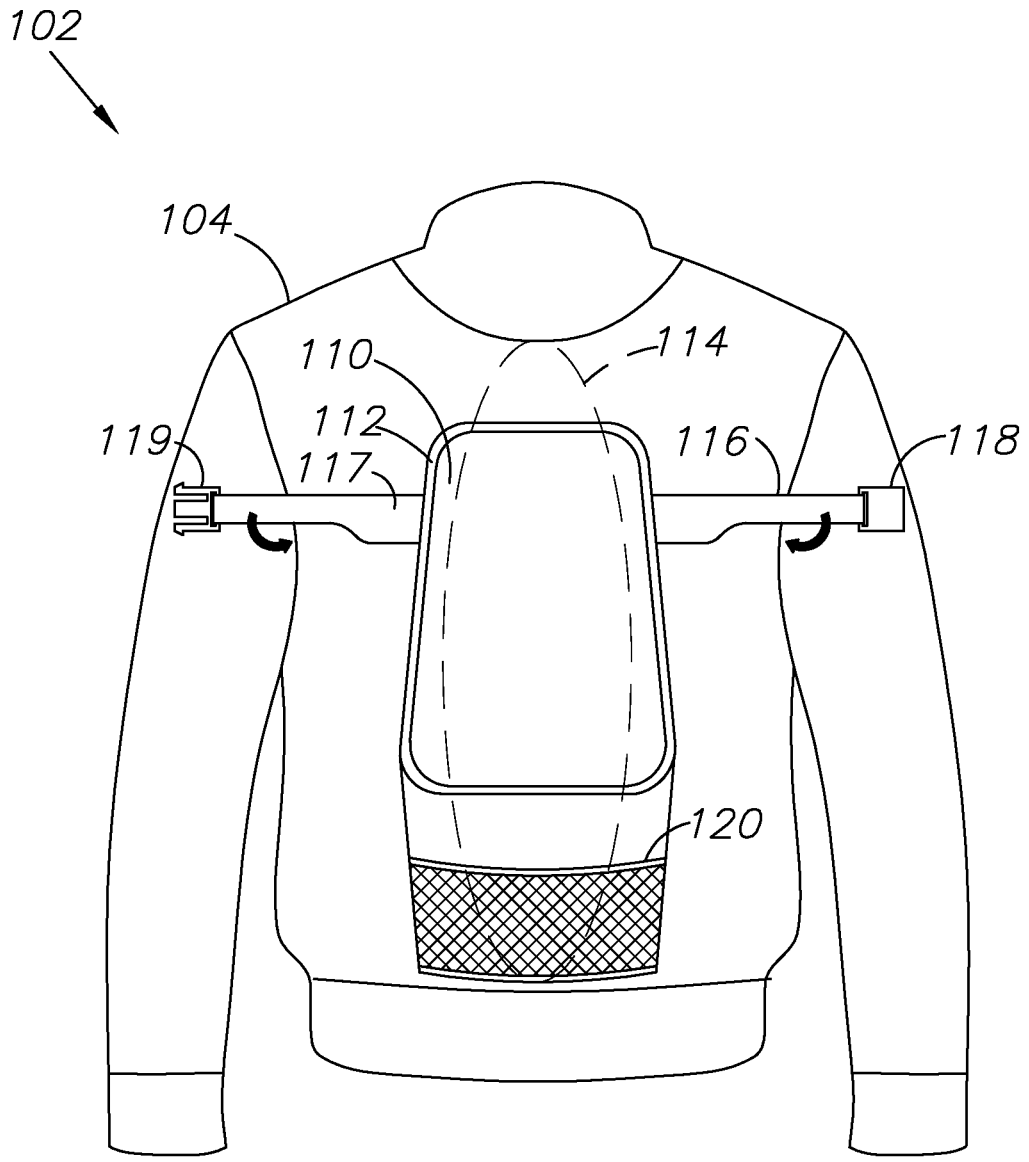
FIG. 14 is a rear elevational view of an alternative embodiment of the present invention.
Figure 15:
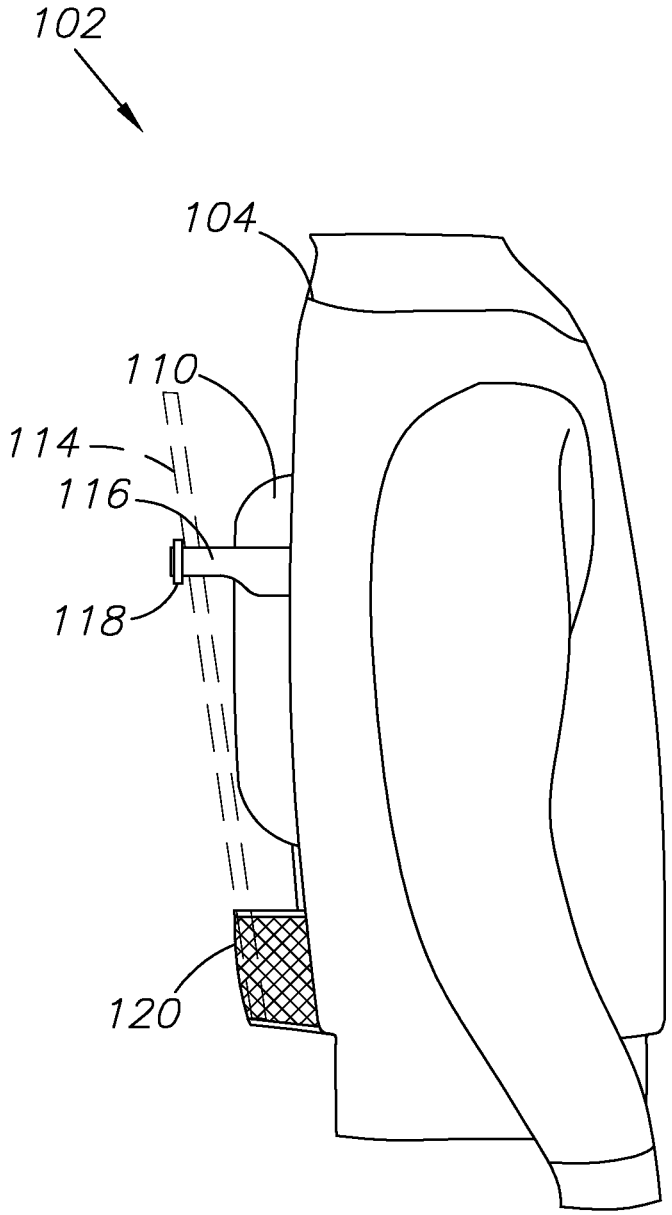
FIG. 15 is a side elevational view thereof.
Figure 16:
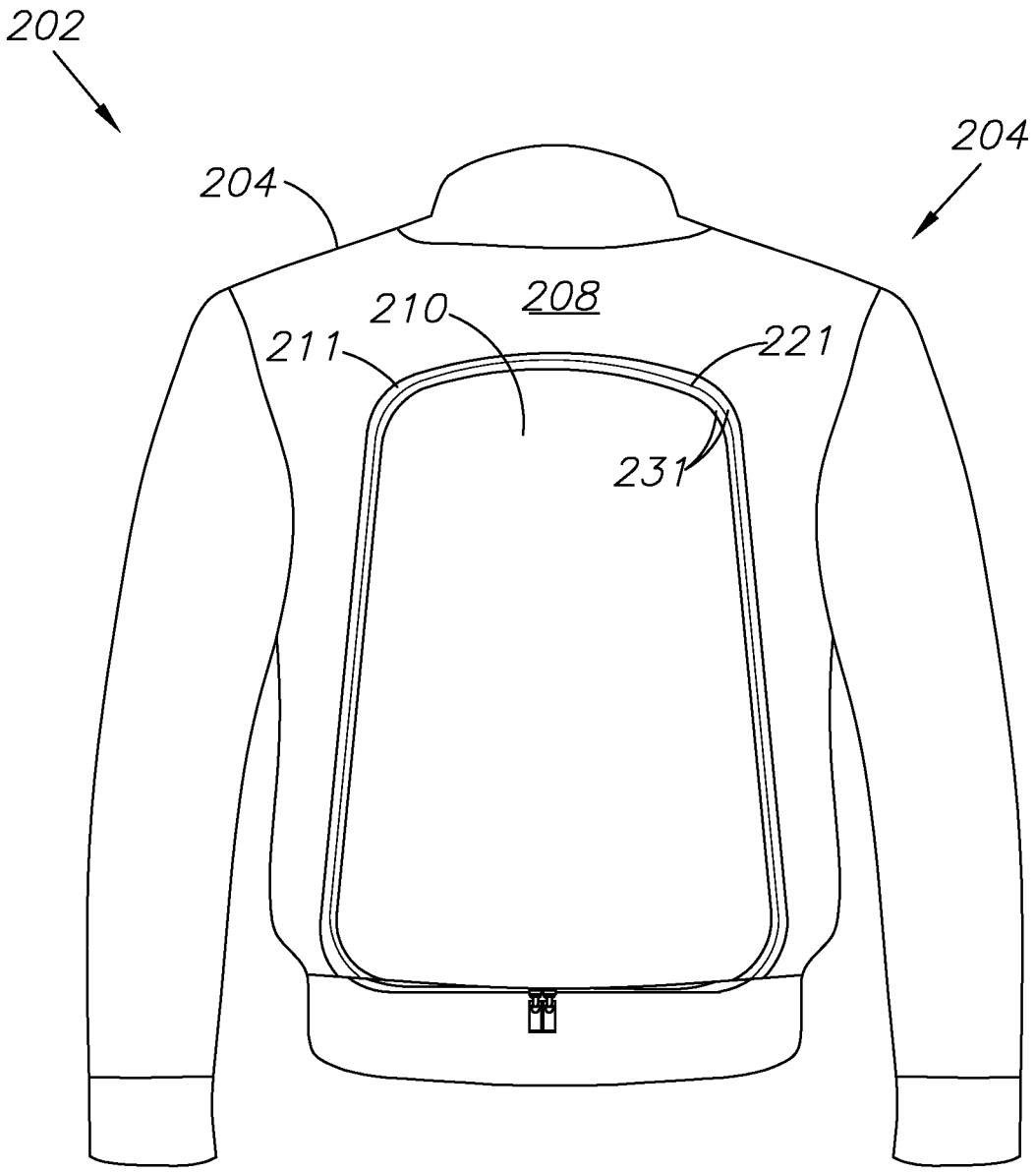
FIG. 16 is rear elevational view of a slightly alternative embodiment of the present invention emphasizing the near-seamless interface between the lid element and the back face of the jacket element.
Figure 17:
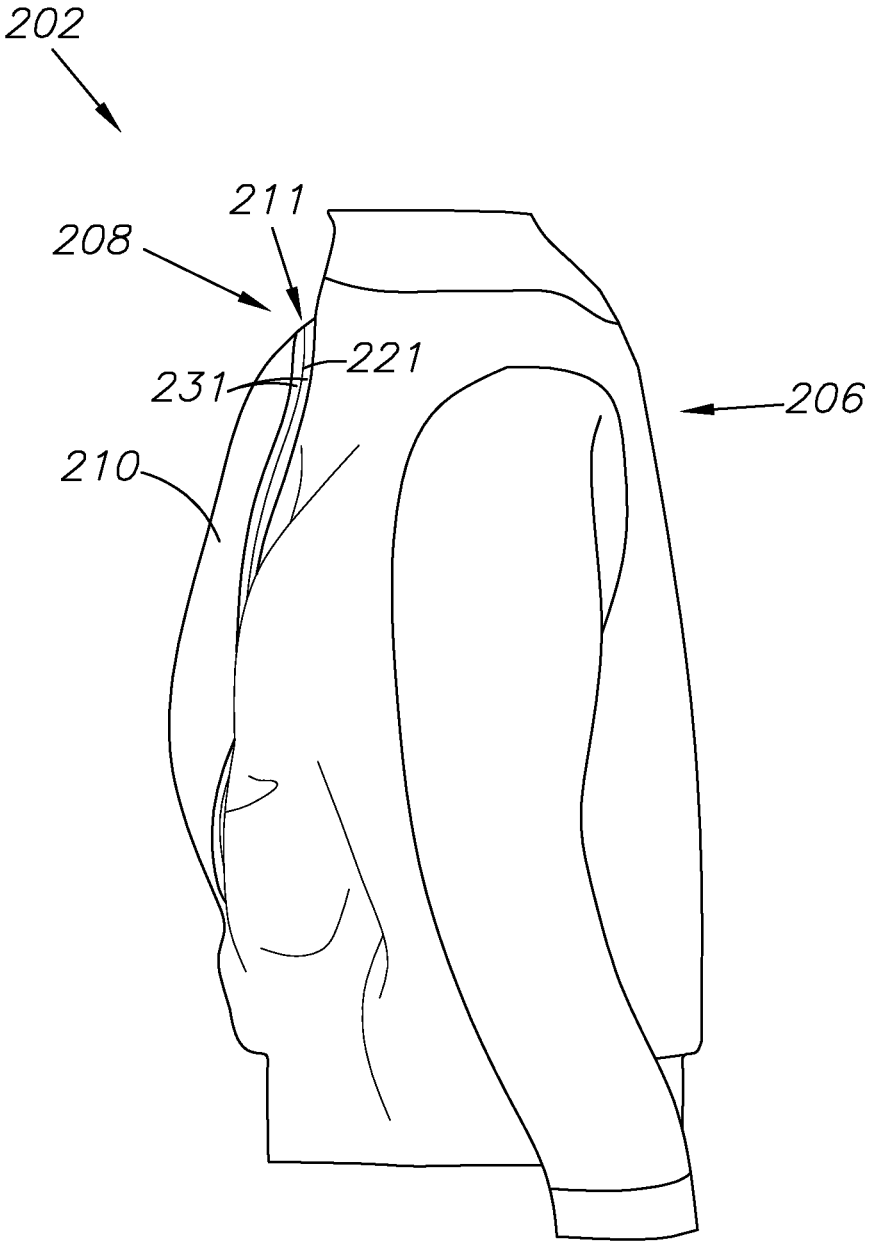
FIG. 17 is a right-side elevational view thereof.
Figure 18:
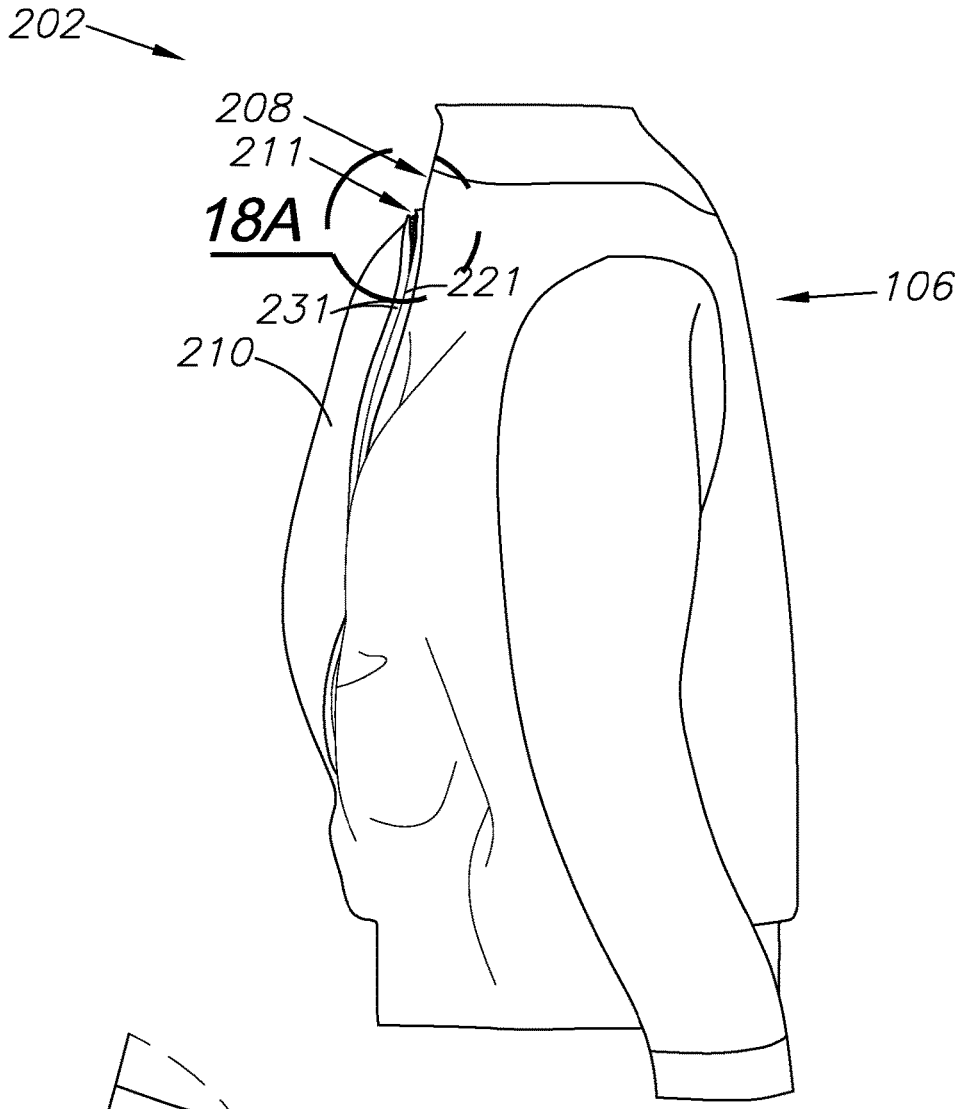
FIG. 18 is a right-side elevational view thereof showing a hidden zipper element.
Figure 18A:
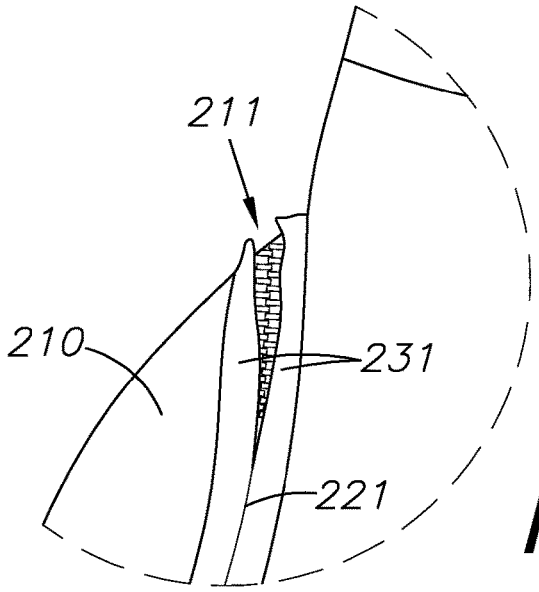
FIG. 18A is a detailed view taken about the circle of FIG. 18.
Figure 19:
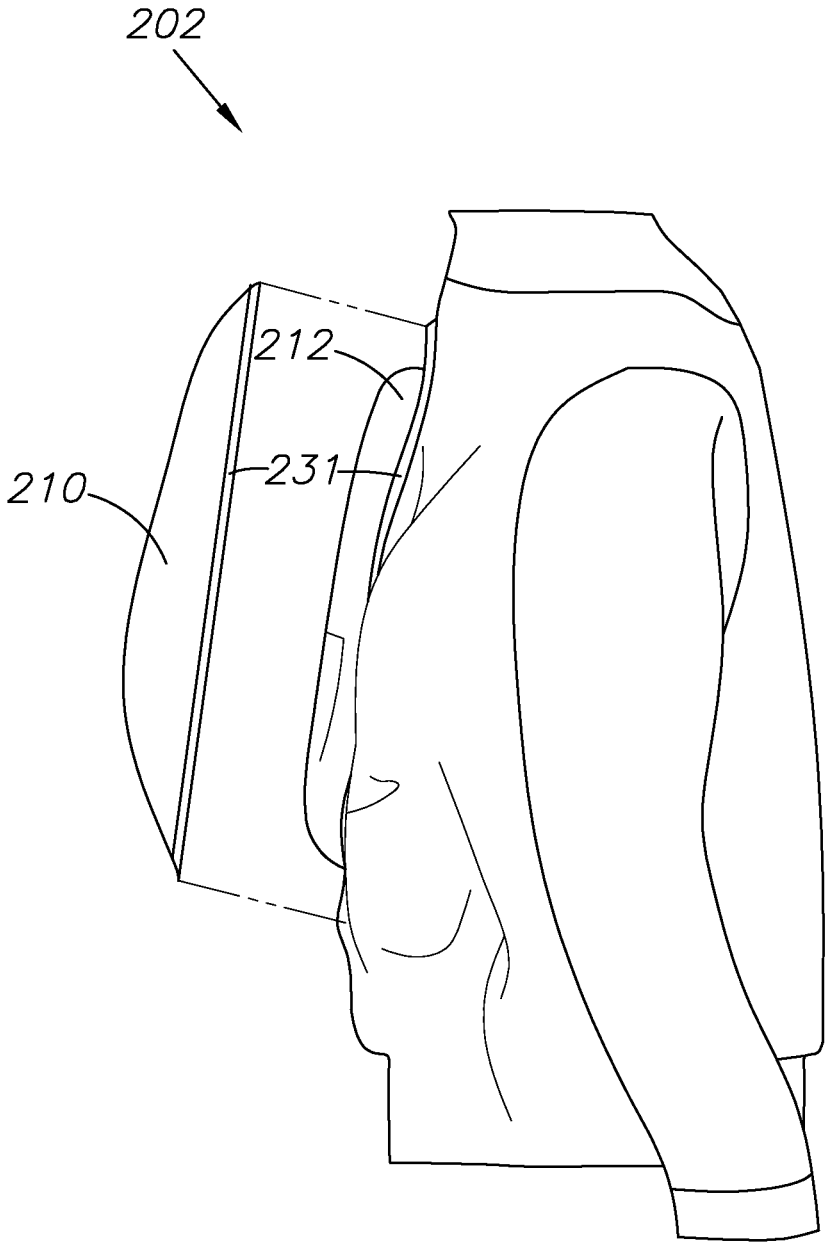
FIG. 19 is a partially exploded right-side elevational view thereof showing the separation of the lid element and the rear face of the jacket element.
Figure 20:
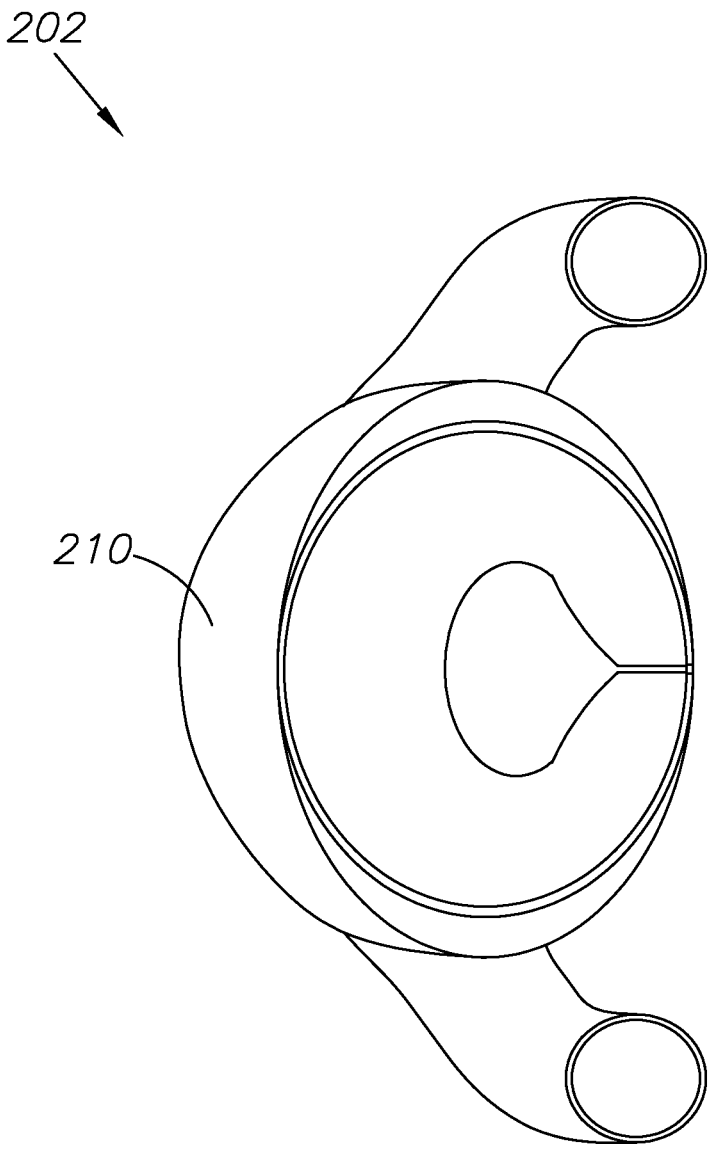
FIG. 20 is a bottom plan view of the embodiment shown in FIG. 16.
Figure 21:
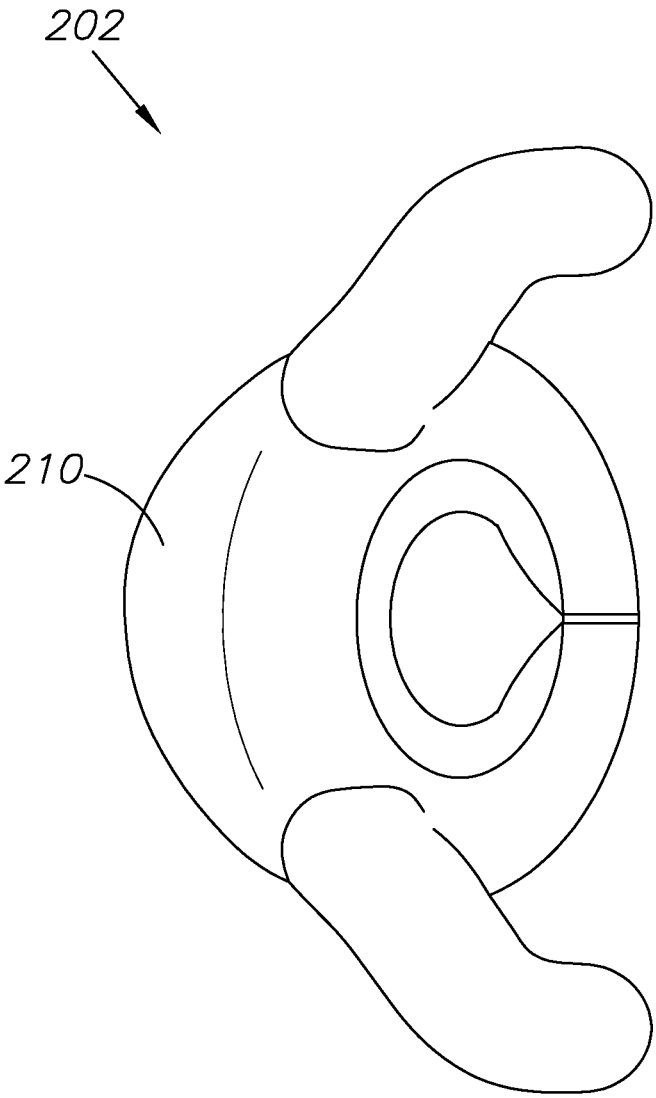
FIG. 21 is a top plan view thereof.

FIGS. 14 and 15 show an alternative embodiment jacket and backpack system 102 which has features for storing a skateboard 114, or other items, over the lid 110 sealing in the backpack with the invisible zipper 112. A first strap 116 and second strap 117, ending in respective first clasp 118 and second clasp 119, can be wrapped around the upper end of the skateboard 114 and clasped to secure the skateboard in place. A pocket 120 attached to the rear face of the jacket 104 secures the bottom end of the skateboard. The pocket 120 could also be used to store other items, such as survival gear.

IV. Alternative Embodiment Jacket and Backpack System 202

FIGS. 16-21 show a slightly alternative embodiment jacket and backpack system 202 which emphasizes the hidden zipper 211 hidden by the jacket seam 221 on the rear face 208 of the jacket 204, which also has a front face 206, and the lid seam 231 of the lid element 210 which is selectively removable from the rear face 208 of the jacket 204. When the lid 210 is secured to the rear face 208 of the jacket 204, the two seams 221, 231 serve to camouflage the hidden zipper 211 from view, making a seamless appearance between the jacket 204 and the lid 210 to hide the backpack element 212 which functions identically to those above. This ensures that the jacket appears to viewers as a standard jacket, hiding the existence of the backpack 212 unless and until the hidden zipper 211 is opened, releasing the lid 210 and allowing access to the backpack 212 which functions as described with regard to the previous embodiments disclosed above.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. An integrated, transformable jacket and backpack system comprising:

a combination jacket and backpack assembly comprising a jacket having a pair of sleeves, an open front, and a rear face housing a cavity permanently connected to a backpack;

said cavity configured to encompass and store said backpack when said combination jacket and backpack assembly is in a first, jacket-only orientation;

a removable lid configured to selectively cover said backpack and said cavity, said removable lid secured to said rear face of said jacket via a hidden zipper;

said removable lid comprising a lid seam and said rear face of said jacket having a jacket seam, said lid seam and said jacket seam configured to camouflage said hidden zipper;

whereby said lid, said lid seam, and said jacket seam are configured to disguise the existence of said lid and said backpack from view such that said jacket appears seamless when in said first, jacket-only orientation;

said backpack comprising an interior space divided into a first storage space and a second storage space separated by a panel;

said first storage space configured to secure and store items;

said backpack comprising a pair of shoulder straps;

wherein said jacket and said backpack are configured to be worn simultaneously when said combination jacket and backpack assembly is in a second, jacket-and-backpack orientation; and said second storage space configured to store said jacket when said combination jacket and backpack assembly is in a third, backpack-only orientation.

2. The system of claim 1, further comprising:

a first strap and a second strap each having a respective proximal end and distal end;

each respective distal end of said first and second straps terminating in a clasp;

each respective proximal end of said first and second straps affixed to said rear face of said jacket;

said clasp configured to selectively join said distal ends to secure an object; and a pocket located below said first and second straps on said rear face of said jacket, said pocket configured to further secure said object.

3. The system of claim 2, wherein said object comprises a skateboard.

4. The system of claim 1, wherein said items stored within said first storage space remain within said first storage space when said combination jacket and backpack is changed from said first, jacket-only orientation into said second, jacket-and-backpack orientation to said third, backpack-only orientation.

5. The system of claim 1, further comprising:

said lid comprising a first face and a second face;

said first face and said second face of said lid comprising distinguishable features; and wherein said lid is reversible, such that either one of said first face and said second face can serve as an exterior face of said jacket.

6. A method of transforming an integrated, transformable jacket and backpack assembly, the method comprising the steps:

providing a combination jacket and backpack assembly comprising a jacket having a pair of sleeves, an open front, and a rear face housing a cavity permanently connected to a backpack;

storing said backpack within said cavity, said backpack comprising an interior space divided into a first storage space and a second storage space separated by a panel;

securing said backpack within said cavity with a removable lid via a hidden zipper, thereby forming a first, jacket-only orientation;

obscuring said backpack within said cavity via a lid seam affixed to said lid a jacket seam affixed to said jacket, wherein said lid seam and said jacket seam camouflage said hidden zipper, thereby hiding it from view when in said first, jacket-only orientation;

exposing said hidden zipper between said lid seam and said jacket seam;

removing said removable lid;

removing said backpack and wearing said backpack over said jacket via a pair of shoulder straps, thereby forming a second, jacket-and-backpack orientation;

removing said backpack and said jacket;

folding said jacket and placing it within said second interior space of said backpack, thereby forming a third, backpack-only orientation; and wearing said backpack via said pair of shoulder straps.

7. The method of claim 6, further comprising the steps:

securing an object to said rear face of said jacket via a pair of straps; and further securing said object to said rear face of said jacket via a pocket located below said pair of straps.

8. The method of claim 6, wherein said pair of straps are joined by a selectively connectable clasp.

9. The method of claim 6, wherein said items stored within said first storage space remain within said first storage space when said combination jacket and backpack is changed from said first, jacket-only orientation into said second, jacket-and-backpack orientation to said third, backpack-only orientation.

* * * * *